United States Patent [19]

Rowan

[11] 4,141,090

[45] Feb. 27, 1979

[54] TRAP AND DRAIN FLUSH OUT KIT

[76] Inventor: Thomas Rowan, 39 Benson St., Bloomfield, N.J. 07003

[21] Appl. No.: 766,227

[22] Filed: Feb. 7, 1977

[51] Int. Cl.[2] ..... E03C 1/306

[52] U.S. Cl. ..... 4/256

[58] Field of Search ..... 4/255–257

[56] References Cited

U.S. PATENT DOCUMENTS

| | | | |
|---|---|---|---|
| 1,476,969 | 12/1923 | Howard | 4/256 |
| 1,985,813 | 12/1934 | Baden | 4/256 |
| 2,086,149 | 7/1937 | Allen | 4/256 |
| 2,673,986 | 4/1954 | Schaefer | 4/255 |
| 3,605,135 | 9/1971 | Tan | 4/256 |

FOREIGN PATENT DOCUMENTS

| | | | |
|---|---|---|---|
| 19122 of | 1895 | United Kingdom | 4/256 |

*Primary Examiner*—Charles E. Phillips
*Attorney, Agent, or Firm*—Richard L. Miller

[57] ABSTRACT

A device for flushing out a clogged drain of a household plumbing system; the device including a long flexible plastic tube which at one end is inserted into the drain and which at its other end is attached to a faucet, a plastic sleeve around the tube forming a seal at the drain opening and an additional grommet being selectively used around the sleeve so to seal a basket sink strainer.

2 Claims, 3 Drawing Figures

Fig. 1
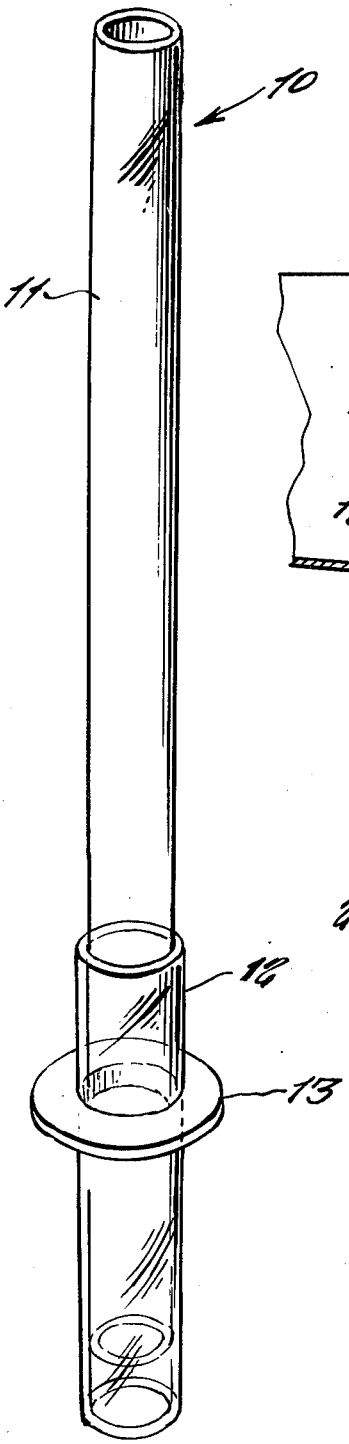
Fig. 2
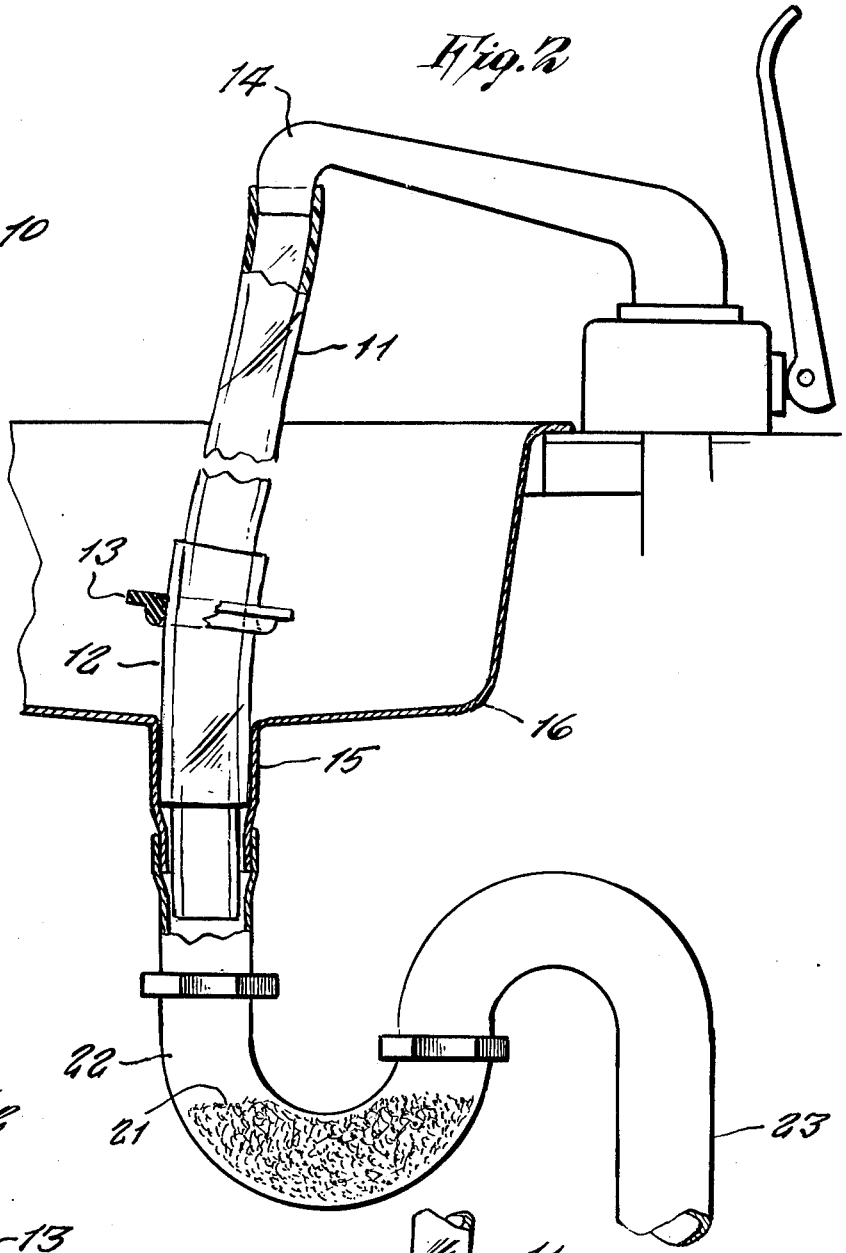
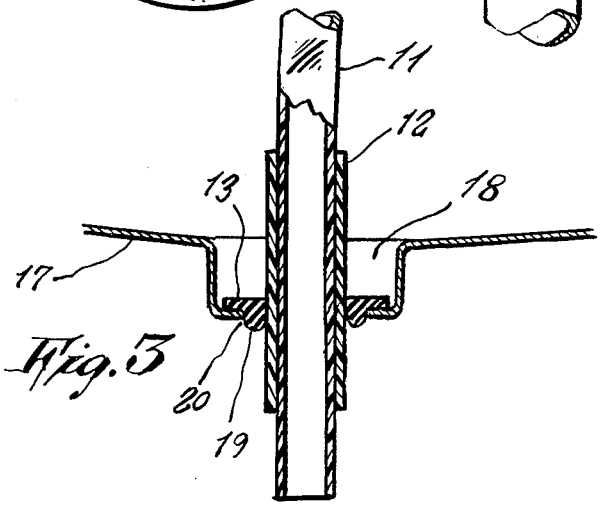
Fig. 3

TRAP AND DRAIN FLUSH OUT KIT

This invention relates generally to devices used to clear clogged plumbing drains and traps.

A principal object of the present invention is to provide a device for quickly and readily clearing a clogged plumbing drain or trap without the necessity of unscrewing any pipes which is laboreous, nor the use of chemicals which can be corrosive to a plumbing system as well as harmful to a septic system.

Another object is to provide a device which utilizes the readily available pressure of water in a fresh water supply system so to do the work of pushing clogging materials out of a clogged drainage system.

Yet a further object is to provide a device consisting of only a few interfitted tubular parts that can be retailed as a kit for easy use by home owners themselves so to maintain plumbing drainage systems clear, and avoid the expense of calling a professional plumber to do the job.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

FIG. 1 is a perspective view of the invention.

FIG. 2 illustrates the invention in use cleaning out a drain.

FIG. 3 illustrates the invention positioned in a sink strainer basket.

Referring now to the drawing in greater detail, the reference numeral 10 represents a trap and drain flush out kit according to the present invention wherein there is an assembly consisting of a long flexible plastic tube 11, a flexible plastic sleeve 12 slidably fitted around the tube, and a flexible rubber grommet 13 slidable around the sleeve.

The tube 11 is of a sufficient length in order that one end thereof can fit into a drain of a household basin, tub or the like, while the other end of the tube can reach a fresh water faucet 14 where water under pressure is readily available so to operate the device. The tube is of an outer diameter so that it fits snugly into the sleeve 12.

The sleeve 12 is shorter in length, and has an inner diameter so to fit snugly around the tube 11, as stated above, while the outer diameter of the sleeve is such as to fit snugly into an opening of a conventional drain 15 of a sink basin 16 or the like, as shown in FIG. 2.

Many kitchen sinks 17, instead of having the above described conventional drain 15, are provided with a basket sink strainer 18, as shown in FIG. 3, and in such cases the grommet 13 is also employed, the grommet being snug-fit around the sleeve. The grommet is positioned so that its rounded bulging side 19 fits into the opening 20 of the basket sink strainer.

Thus in both forms of use illustrated in FIG. 2 and FIG. 3, the device seals the drain entry so that any pressure that will be built up inside the drain will not dissipate upward out of the drain entry.

In operative use, it will now be evident that when the device is installed between the faucet and drain as indicated, and the faucet is turned on, the pressure of the fresh water is instantly applied directly against the material 21 lodged in the trap 22, such pressure being sufficient in most instances so to dislodge the substance and force it to move down the drain pipe 23 and into the sewer.

While certain novel features of this invention have been shown and described and are pointed out in the annex claims, it will be understood that various omissions, substitutions and changes in the forms and details of the device illustrated and in its operation can be made by those skilled in the art without departing from the spirit of the invention.

What is claimed is:

1. A trap and drain flush out kit, comprising in combination, a flexible plastic tube, a flexible plastic sleeve and a flexible rubber grommet, said flexible plastic tube snug-fitted but slidable in said flexible plastic sleeve and capable of extending completely therethrough, said flexible plastic sleeve being snug-fitted but slidable in said flexible rubber grommet and extending completely through the grommet, said tube being of sufficient length so as to reach between a fresh water faucet and extend into a drain of a basin, tub, or the like, said flexible plastic sleeve having a diameter to snugly fit into a drain of a conventional size and said flexible rubber grommet being of a diameter to snugly fit into a drain of a different size such as the type accepting a basket strainer, the length of the flexible plastic sleeve being substantially less than said flexible plastic tube and the length of said flexible rubber grommet being less than said flexible plastic sleeve.

2. The combination as set forth in claim 1 wherein said tube is of a size to fit snugly on said faucet.

* * * * *